US006843637B1

(12) United States Patent
Pothier et al.

(10) Patent No.: US 6,843,637 B1
(45) Date of Patent: Jan. 18, 2005

(54) COOLING CIRCUIT WITHIN A TURBINE NOZZLE AND METHOD OF COOLING A TURBINE NOZZLE

(75) Inventors: Michael R. Pothier, Leominster, MA (US); John R. Seymour, Harvard, MA (US); David Leo, Leominster, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/632,851

(22) Filed: Aug. 4, 2003

(51) Int. Cl.[7] ..... F01D 9/06
(52) U.S. Cl. ..... 415/114; 415/116
(58) Field of Search ..... 415/114, 115, 415/116; 416/96 R, 96 A, 97 R

(56) References Cited

U.S. PATENT DOCUMENTS 5,498,126 A * 3/1996 Pighetti et al. ..... 415/115
5,634,766 A * 6/1997 Cunha et al. ..... 415/115
5,975,850 A * 11/1999 Abuaf et al. ..... 416/97 R
6,227,798 B1 5/2001 Demers et al.
6,270,317 B1 8/2001 Manning et al.
6,331,096 B1 12/2001 Burdgick et al.
6,375,415 B1 4/2002 Burdgick
6,386,825 B1 5/2002 Burdgick
6,394,749 B2 5/2002 Yu et al.
6,406,254 B1 6/2002 Itzel et al.
6,418,618 B1 7/2002 Burdgick
6,419,445 B1 7/2002 Burdgick
6,517,312 B1 * 2/2003 Jones et al. ..... 415/115
6,543,993 B2 4/2003 Burdgick et al.

* cited by examiner

*Primary Examiner*—Christopher Verdier
(74) *Attorney, Agent, or Firm*—Nixon & Vanderhye P.C.

(57) ABSTRACT

A cooling circuit is provided within a turbine nozzle to help increase turbine efficiency. The turbine nozzle includes first, second and third cavities, an outer band, and an inner band. The cooling circuit contains an inlet receiving cooling medium flow, and a first duct insert disposed in the second cavity. The first duct insert receives the cooling medium flow via the inlet and duct flows the cooling medium flow to a bottom of the second cavity. An impingement insert is disposed in the first cavity that receives the cooling medium flow from the first duct insert. A first impingement plate is disposed within the outer band defining an outer band cooling path within the outer band. The outer band cooling path receives the cooling medium flow from the first cavity. A second cavity cooling path is defined between the first duct insert and a second cavity wall, where the second cavity cooling path receives the cooling medium flow from the outer band cooling path. A second impingement plate is disposed within the inner band and defines an inner band cooling path within the inner band. The inner band cooling path receives the cooling medium flow from second cavity cooling path. Finally, a second duct insert is disposed in the third cavity and defines a third cavity cooling path between the second duct insert and a third cavity wall. The third cavity cooling path receives the cooling medium flow from the inner band cooling path.

10 Claims, 3 Drawing Sheets

COOLING CIRCUIT WITHIN A TURBINE NOZZLE AND METHOD OF COOLING A TURBINE NOZZLE

BACKGROUND OF THE INVENTION

The present invention relates to a cooling circuit in a turbine nozzle and, more particularly, to a cooling circuit within a turbine nozzle that allows for optimum cooling of the nozzle while maintaining system integrity and life goals.

Recent turbine designs are high output, high efficiency gas turbines utilizing steam or air cooling within several of the hot gas path components. The construction presents new issues within the stator components on how to efficiently use the improved steam or air cooling properties yet contain the high pressures and temperatures within the structure and still survive in the environment of the hot gas path. Base metal temperature, steam temperature rise, steam pressure, flow and geometry are a few of the considerations for ensuring a component life that meets program goals.

BRIEF DESCRIPTION OF THE INVENTION

In an exemplary embodiment of the invention, a closed loop cooling circuit is provided within a turbine nozzle, the turbine nozzle including first, second and third cavities, an outer band, and an inner band. The cooling circuit includes an inlet receiving cooling medium flow, and a first duct insert disposed in the second cavity. The first duct insert receives the cooling medium flow via the inlet and duct flows the cooling medium flow to a bottom of the second cavity. An impingement insert is disposed in the first cavity that receives the cooling medium flow from the first duct insert. A first impingement plate is disposed within the outer band defining an outer band cooling path within the outer band. The outer band cooling path receives the cooling medium flow from the first cavity.

A second cavity cooling path is defined between the first duct insert and a second cavity wall, where the second cavity cooling path receives the cooling medium flow from the outer band cooling path. A second impingement plate is disposed within the inner band and defines an inner band cooling path within the inner band. The inner band cooling path receives the cooling medium flow from second cavity cooling path. Finally, a second duct insert is disposed in the third cavity and defines a third cavity cooling path between the second duct insert and a third cavity wall. The third cavity cooling path receives the cooling medium flow from the inner band cooling path.

In another exemplary embodiment of the invention, a cooling circuit is provided within a turbine nozzle, the turbine nozzle including first, second and third cavities, an outer band, and an inner band. The cooling circuit includes an inlet receiving cooling medium flow, and a first duct insert disposed in the second cavity. The first duct insert receives the cooling medium flow via the inlet. An elbow connection receives the cooling medium flow via the first duct insert and guides the cooling medium flow toward the first cavity. An impingement insert is disposed in the first cavity, which impingement insert receives the cooling medium flow via the elbow connection. A first impingement plate is disposed within the outer band and defines an outer band cooling path within the outer band. The outer band cooling path terminates in a communication slot adjacent the second cavity, wherein the cooling medium flow passes through the communication slot via the outer band cooling path.

A second cavity cooling path is defined between the first duct insert and a second cavity wall, which second cavity cooling path receives the cooling medium flow via the communication slot. A second impingement plate is disposed within the inner band and defines an inner band cooling path within the inner band. The inner band cooling path terminates in a third cavity entrance, wherein the cooling medium flow passes through the third cavity entrance via the inner band cooling path. Finally, a second duct insert is disposed in the third cavity defining a third cavity cooling path between the second duct insert and a third cavity wall. The third cavity cooling path receives the cooling medium flow via the third cavity entrance.

In yet another exemplary embodiment of the invention, a method of cooling a turbine nozzle via a cooling circuit includes the steps of duct flowing a cooling medium flow to a bottom of the second cavity via a first duct insert and guiding the cooling medium flow toward the first cavity; impingement cooling the first cavity with the cooling medium flow; defining an outer band cooling path within the outer band, and impingement cooling the outer band with the cooling medium flow; defining a second cavity cooling path within the second cavity between the first duct insert and a second cavity wall, and duct cooling the second cavity with the cooling medium flow; defining an inner band cooling path within the inner band, and impingement cooling the inner band with the cooling medium flow; and defining a third cavity cooling path within the third cavity between a second duct insert and a third cavity wall, and duct cooling the third cavity with the cooling medium flow.

DETAILED DESCRIPTION OF THE INVENTION

Figure 1:
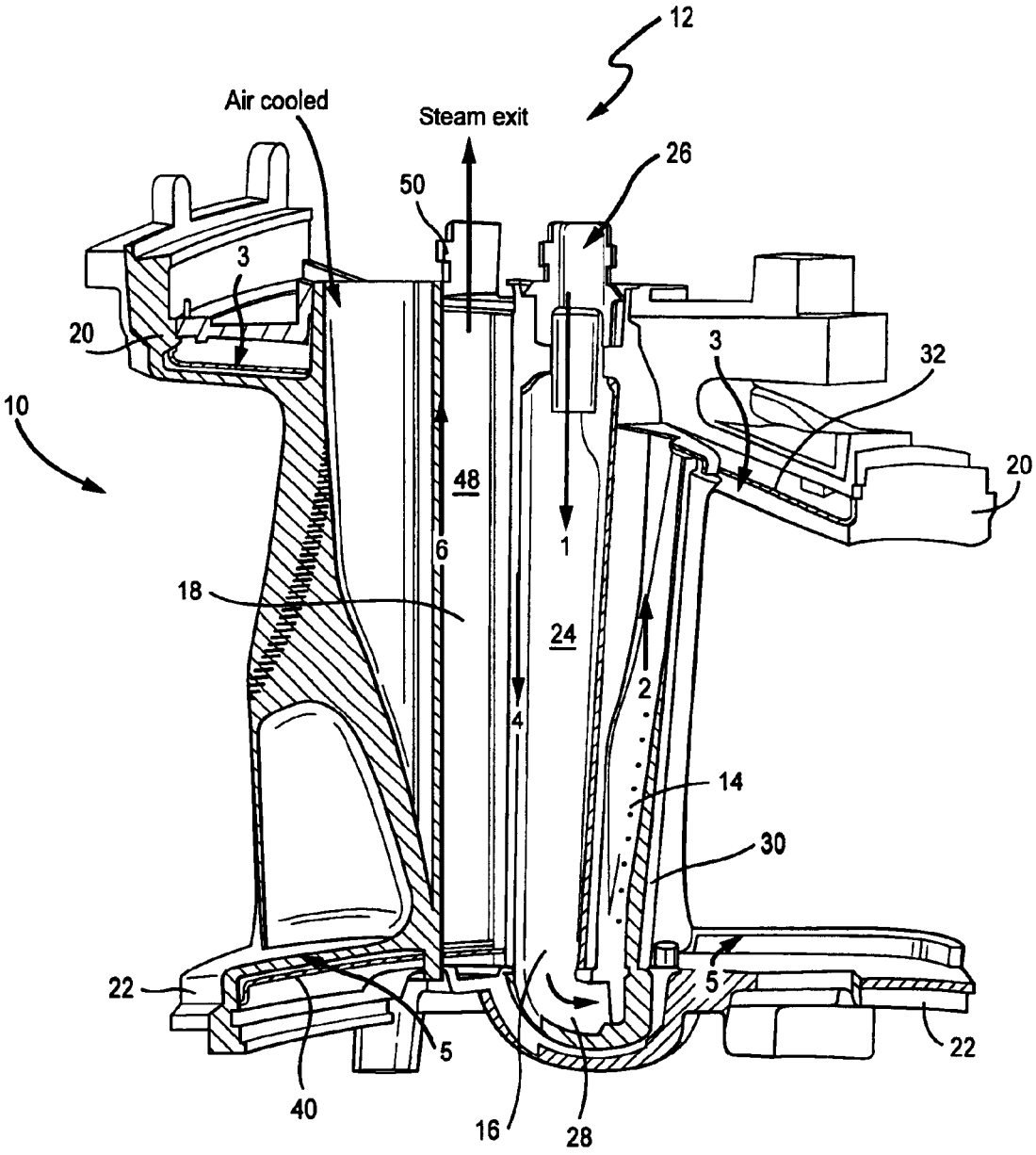
FIG. 1 is a cross sectional view showing the cooling circuit and internal turbine nozzle structure of the present invention.

FIG. 1 is a cross section through a turbine nozzle 10 showing the steam cooling circuit 12 of the present invention. Although the invention will be described in the context of a steam cooling circuit, those of ordinary skill in the art will appreciate that the circuit has the capability of running either on steam or air as the cooling medium.

The turbine nozzle internal structure includes a first cavity 14, termed cavity one, a second cavity 16, termed cavity two, and a third cavity 18, termed cavity three. The nozzle 12 also includes an outer band 20 and an inner band 22. The cooling circuit 12 of the present invention endeavors to effect cooling of the first, second and third cavities as well as the inner and outer bands to help increase turbine efficiency.

The cooling circuit 12 is preferably a closed loop cooling circuit for increased cooling efficiency.

A duct insert 24 is disposed within cavity two 16 and receives cooling medium flow via an inlet 26. Preferably, a spoolie or like connection is made from the bottom of the cavity cover to the top of the insert 24. Designated via arrow 1, the steam is ducted to the bottom of cavity two 16 via the duct insert 24. An elbow connection 28 receives the cooling medium flow via the duct insert 24 and guides the cooling medium flow toward cavity one 14. An impingement insert 30 is disposed in cavity one 14 and receives the cooling medium flow via the elbow connection 28. As shown in FIG. 1, the impingement insert 30 includes openings along cavity one 14 (as opposed to the duct insert 24) to effect impingement cooling of cavity one 14. The path of the medium flow through the impingement insert 30 in cavity one 14 is shown via arrow 2. Spent steam travels to the back side of the impingement insert 30 and up through an orificed hole to an outer band pre-impingement region 34 (see FIG. 2).

Figure 2:
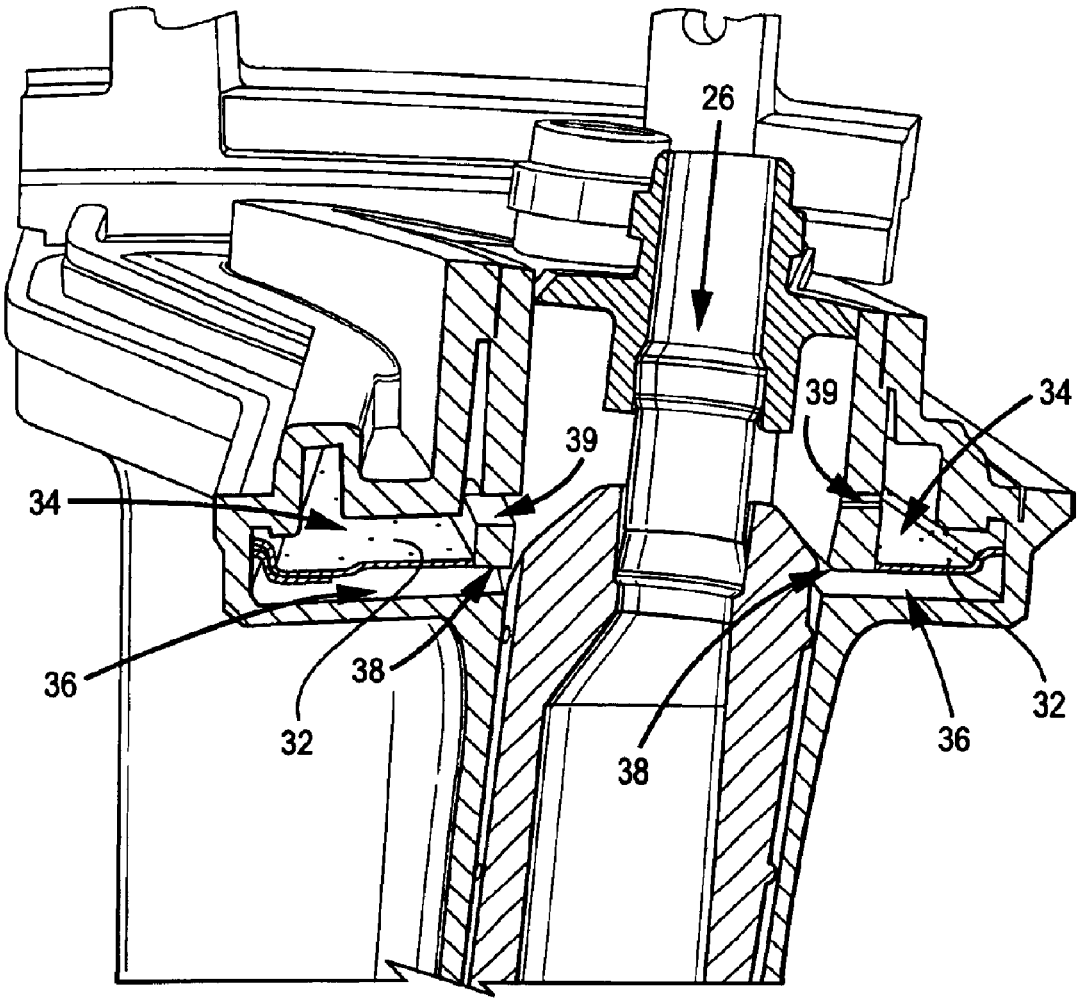
FIG. 2 is an enlarged view of the cooling circuit showing communication slots/bypass holes on the outer band.

With continued reference to FIGS. 1 and 2, an impingement plate 32 is disposed within the outer band 20 and defines an outer band cooling path within the outer band. The impingement plate 32 divides the outer band into a pre-impingement region 34 and a post-impingement region 36. The outer band cooling path terminates in a communication slot 38 adjacent cavity two 16. As shown via arrows 3, the steam travels throughout the outer band 20 in the pre-impingement region 34 and impingement cools the outer band via the impingement plate 32. The steam then passes through the communication slot 38 and bypass holes 39 into a cavity two cooling path in cavity two 16 between the duct insert 24 and a cavity two wall. See arrow 4. The cavity two cooling path receives the steam flow via the communication slot 38. The steam in the cavity two cooling path cools cavity two 16 via duct cooling. The steam is essentially forced down along the outside of the duct insert 24 within cavity two 16 to increase velocity and cooling effectiveness.

Figure 3:
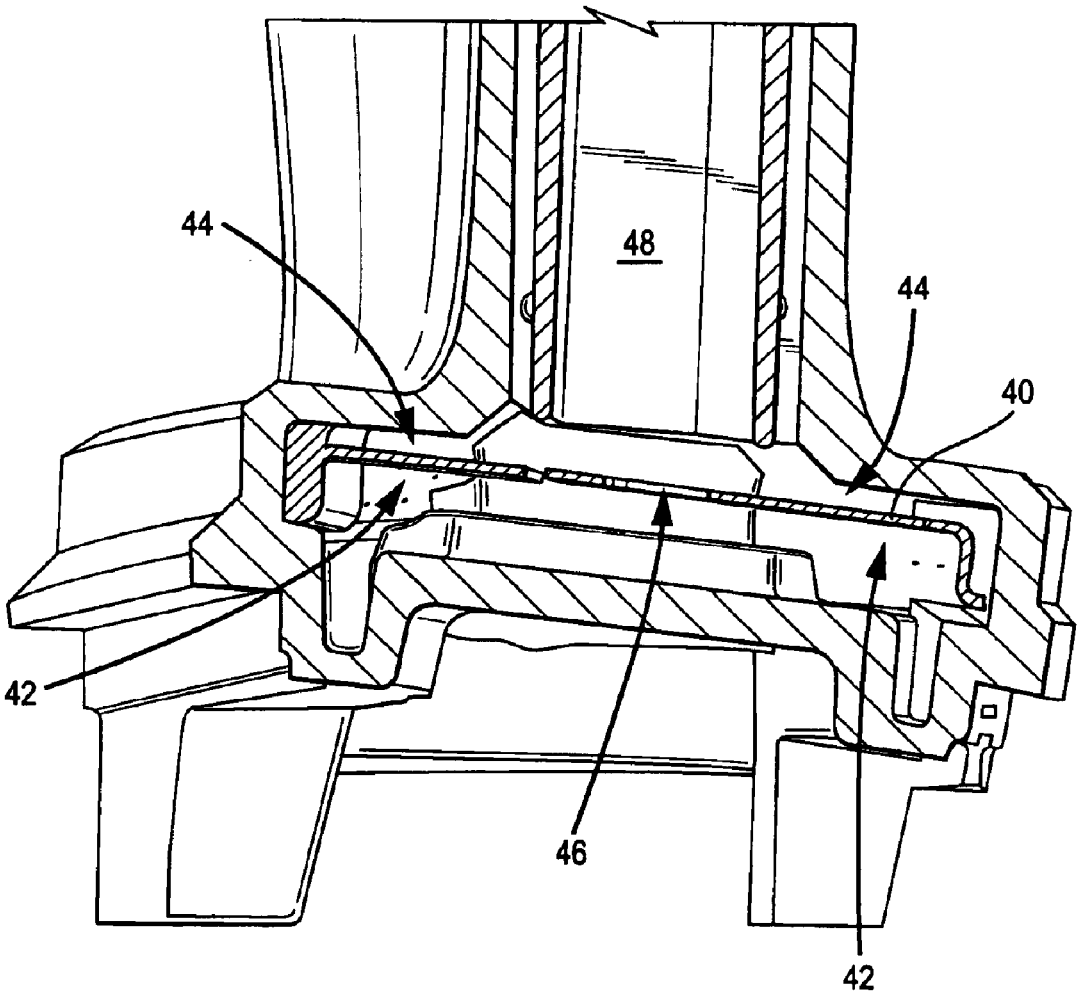
FIG. 3 is an enlarged view of the post impingement region of the inner sidewall through to cavity three bypass and entrances.

With reference to FIGS. 1 and 3, an inner band impingement plate 40 is disposed within the inner band 22 and defines an inner band cooling path within the inner band. Like the outer band 20, the inner band includes a pre-impingement region 42 and a post-impingement region 44. The inner band cooling path terminates in a cavity three entrance or bypass hole 46. The steam travels throughout the inner band 22 in the pre-impingement region 42 and then impingement cools the outer band post-impingement region 44 via the impingement plate 40. See arrows 5. The steam then passes through the cavity three entrance hole 46.

A solid duct insert 48 is disposed within cavity three 18 and defines a cavity three cooling path between the duct insert 48 and a wall of cavity three 18. The steam travels in the cavity three cooling path as shown via arrow 6 to duct cool cavity three 18. Subsequently, the steam exits through an exit flange 50 on top of cavity three 18 to external piping.

Steam cooling in the turbine nozzle helps to increase turbine efficiency to upwards of 60% in a combined cycle mode. By using steam as the primary cooling medium, much higher flow path temperatures can be tolerated by the base metal due to the increased cooling efficiency. The cooling circuit of the present invention preferably contains the steam within the nozzle structure while taking the maximum benefit from the steam for cooling purposes. As noted, although steam is the preferred cooling medium, the cooling circuit of the invention is capable of using air as the cooling medium.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A closed loop cooling circuit within a turbine nozzle including first, second and third cavities, an outer band, and an inner band, the cooling circuit comprising:

an inlet receiving cooling medium flow;

a first duct insert disposed in the second cavity, the first duct insert receiving the cooling medium flow via the inlet and duct flowing the cooling medium flow to a bottom of the second cavity;

an impingement insert disposed in the first cavity and receiving the cooling medium flow from the first duct insert;

a first impingement plate disposed within the outer band and defining an outer band cooling path within the outer band, the outer band cooling path receiving the cooling medium flow from the first cavity;

wherein a second cavity cooling path is defined between the first duct insert and a second cavity wall, the second cavity cooling path receiving the cooling medium flow from the outer band cooling path;

a second impingement plate disposed within the inner band and defining an inner band cooling path within the inner band, the inner band cooling path receiving the cooling medium flow from second cavity cooling path; and a second duct insert disposed in the third cavity defining a third cavity cooling path between the second duct insert and a third cavity wall, the third cavity cooling path receiving the cooling medium flow from the inner band cooling path.

2. A closed loop cooling circuit according to claim 1, further comprising an elbow connection disposed between the first duct insert and the impingement insert, the elbow connection guiding the cooling medium flow from the first duct insert to the impingement insert.

3. A closed loop cooling circuit according to claim 1, further comprising an exit flange disposed at an end of the third cavity cooling path, the cooling medium flow being exhausted from the turbine nozzle via the exit flange.

4. A closed loop cooling circuit according to claim 1, wherein the cooling medium flow is steam.

5. A closed loop cooling circuit according to claim 1, wherein the cooling medium flow is air.

6. A cooling circuit within a turbine nozzle including first, second and third cavities, an outer band, and an inner band, the cooling circuit comprising:

an inlet receiving cooling medium flow;

a first duct insert disposed in the second cavity, the first duct insert receiving the cooling medium flow via the inlet;

an elbow connection receiving the cooling medium flow via the first duct insert, the elbow connection guiding the cooling medium flow toward the first cavity;

an impingement insert disposed in the first cavity, the impingement insert receiving the cooling medium flow via the elbow connection;

a first impingement plate disposed within the outer band and defining an outer band cooling path within the outer band, the outer band cooling path terminating in a communication slot adjacent the second cavity, wherein the cooling medium flow passes through the communication slot via the outer band cooling path;

wherein a second cavity cooling path is defined between the first duct insert and a second cavity wall, the second cavity cooling path receiving the cooling medium flow via the communication slot;

a second impingement plate disposed within the inner band and defining an inner band cooling path within the inner band, the inner band cooling path terminating in a third cavity entrance, wherein the cooling medium flow passes through the third cavity entrance via the inner band cooling path; and a second duct insert disposed in the third cavity defining a third cavity cooling path between the second duct insert and a third cavity wall, the third cavity cooling path receiving the cooling medium flow via the third cavity entrance.

7. A cooling circuit according to claim 6, further comprising an exit flange disposed at an end of the third cavity cooling path, the cooling medium flow being exhausted from the turbine nozzle via the exit flange.

8. A cooling circuit according to claim 6, wherein the cooling medium flow is steam.

9. A cooling circuit according to claim 6, wherein the cooling medium flow is air.

10. A cooling circuit according to claim 6, wherein the cooling circuit is a closed loop.

* * * * *